US009162257B2

(12) United States Patent
Schulz et al.

(10) Patent No.: US 9,162,257 B2
(45) Date of Patent: Oct. 20, 2015

(54) METHOD AND DEVICE FOR DISTRIBUTING PACKAGES AND OTHER SIMILAR DISPATCHED ARTICLES

(75) Inventors: Jürgen Schulz, Döbeln (DE); Hartwig Hoffmann, Mochau (DE); Bernhard Brönner, Dresden (DE); Andreas Hartwig, Radebeul (DE)

(73) Assignee: Red Parcel Post AG, Leipzig (DE)

( * ) Notice: Subject to any disclaimer, the term of this patent is extended or adjusted under 35 U.S.C. 154(b) by 3152 days.

(21) Appl. No.: 10/553,292

(22) PCT Filed: Apr. 16, 2004

(86) PCT No.: PCT/EP2004/004105

§ 371 (c)(1),
(2), (4) Date: Nov. 10, 2006

(87) PCT Pub. No.: WO2004/091813

PCT Pub. Date: Oct. 28, 2004

(65) Prior Publication Data

US 2007/0062851 A1 Mar. 22, 2007

(30) Foreign Application Priority Data

Apr. 16, 2003 (DE) ..... 103 17 855

(51) Int. Cl.
*G06Q 10/00* (2012.01)
*B07C 3/00* (2006.01)

(52) U.S. Cl.
CPC ..... *B07C 3/00* (2013.01)

(58) Field of Classification Search
None
See application file for complete search history.

(56) References Cited

U.S. PATENT DOCUMENTS 4,832,204 A * 5/1989 Handy et al. ..... 209/3.3
5,362,949 A * 11/1994 Gulick ..... 235/385
5,971,587 A * 10/1999 Kato et al. ..... 700/115
6,015,039 A * 1/2000 Bonnet ..... 198/368

(Continued)

FOREIGN PATENT DOCUMENTS

DE 4412097 C1 6/1995
DE 199 59 223 C1 12/1999

(Continued)

*Primary Examiner* — Fateh M Obaid
(74) *Attorney, Agent, or Firm* — Occhiuti & Rohlicek LLP

(57) ABSTRACT

In a method for distributing packages or similar dispatched articles, packages that are to be transported from a private and/or commercial sender to an addressee are acquired in a collecting location. In this collecting location, the packages are provided with a package code that has electronically detectable data, and subsequently, the packages are distributed and/or delivered by means of transport vehicles. According to the invention, the collected packages are supplied to a HUB center that is connected to several collecting locations and in the HUB center the respective package codes are expanded with measurement data (length, width, height, weight) of the package to a package routing code. These package routing codes of all packages are supplied to a central computer and the packages are arranged in accordance with a route planning that can be dynamically optimized by the central computer into a sequence that is sorted in accordance with distribution zones. This package arrangement as well as the package routing codes are received by a vehicle in a distribution-compatible sorted arrangement and, subsequently, the packages are delivered by a controlled distribution in an automatically controllable way to the addressee.

23 Claims, 5 Drawing Sheets

(56) References Cited

U.S. PATENT DOCUMENTS

| | | | | |
|---|---|---|---|---|
| 6,273,267 | B1 * | 8/2001 | Tamamoto et al. | 209/547 |
| 6,601,073 | B1 * | 7/2003 | Robare | 1/1 |
| 2001/0030147 | A1 * | 10/2001 | Tamamoto et al. | 209/547 |
| 2002/0111914 | A1 * | 8/2002 | Terada et al. | 705/60 |
| 2002/0130065 | A1 * | 9/2002 | Bloom | 209/630 |
| 2004/0118907 | A1 * | 6/2004 | Rosenbaum et al. | 235/375 |
| 2004/0220957 | A1 * | 11/2004 | McDonough | 707/102 |
| 2005/0149373 | A1 * | 7/2005 | Amling et al. | 705/8 |
| 2007/0102329 | A1 * | 5/2007 | Rosenbaum et al. | 209/584 |

FOREIGN PATENT DOCUMENTS

| | | | |
|---|---|---|---|
| DE | 100 34 858 | A1 | 7/2000 |
| DE | 101 53 626 | A1 | 10/2001 |
| EP | 1 036 602 | A2 | 9/2000 |
| EP | 1 298 552 | B1 | 11/2006 |
| JP | 08-268513 | | 10/1996 |
| JP | 09-054807 | | 2/1997 |
| JP | 10-228599 | | 8/1998 |
| JP | 2003-165627 | | 6/2003 |

* cited by examiner

METHOD AND DEVICE FOR DISTRIBUTING PACKAGES AND OTHER SIMILAR DISPATCHED ARTICLES

BACKGROUND OF THE INVENTION

The invention relates to a method and a device for distributing packages and other similar dispatched articles.

In known methods for distributing packages (EP 1 036 602 A2; EP 1 298 552 A2) the packages received in collecting locations are provided with a routing label and transported by long distance transport to receiving depots, respectively. Starting at such a receiving depot that functions as a trans-shipment center the packages are distributed to transport belts wherein the package codes that are contained in the routing label are detected by means of a manual scanner and, subsequently, the packages are moved to a delivery vehicle. With said vehicle, in accordance with the knowledge of the delivery person, a corresponding distribution route is then traveled within a delivery area. In such a delivery system an optimization in accordance with time and cost criteria is possible only in the area of internal sequences before or within the receiving depot and a tracking action for quality assurance of the distribution requires high expenditure. A direct tracking of an individual package is not possible.

The invention concerns the problem of providing a method and a device for distributing packages with which in a shorter amount of time an automatic distribution of the packages is achievable by means of improved identification codes, wherein the codes are useable by means of a computer program for controlling loading of standardized cargo spaces, and, in this connection, a maximum cargo space utilization, maximum carrying load, minimal transport distances as well as a simple controllable package delivery at reduced cost are possible.

SUMMARY OF THE INVENTION

The invention solves this problem with a method wherein the collected packages are supplied to a HUB center that is connected to several collecting locations, wherein in the HUB center the respective package codes are combined with measurement data (length, width, height, weight), the geo coordinates (addressees) as well as identification data of the package to a controllable package routing code, and wherein these package routing codes of all packages are supplied to a central computer in such a way that, subsequently, the packages by means of output signals generated by the program of the central computer and effecting a dynamically optimizable route planning are arranged in a sequence sorted in accordance with distribution zones, that this sorted package sequence as well as the package routing codes are introduced into transport boxes in a distribution-compatible sorted arrangement, the transport boxes are transferred onto a vehicle, and, subsequently, the packages are delivered by a navigation-controlled distribution in an automatically controllable way to the addressee. The invention is further solved by a device for distributing packages or similar dispatched articles, in particular, for performing the aforementioned method, wherein the device comprises a HUB center and in the area of the HUB center is provided with a measuring device comprising sensor units for detecting identification data, package sizes (length, width, height, weight), addresses and geo coordinates, respectively, wherein the measured data can be supplied to a computer correlating the data to the packages as descriptive data such that by means of the measured data processed by the computer in the HUB center a control action is effected with which the sortable packages are transferable in an ordered sequence into at least one vehicle and the packages are distributable by a route planning that is dynamically optimized by the expanded data set. With regard to important further embodiments reference is being had to the dependent claims.

In the inventive method for distribution and delivery of packages provided with an information carrier, the packages are sent to a trans-shipment and sorting location that is a main trans-shipment base and is referred to as a HUB center. By utilizing modern data acquisition and data processing technology, at the HUB center the labels, the geo coordinates of the address and the like that have already been applied in the form of an identification code on the packages at the collecting location are checked or the identification codes are applied onto the information carrier. At the HUB center, each package therefore has individual data of its package code that is used for a dynamic optimizable route planning.

In this way, a plurality of packages, for example, the collection of a day, can be sorted within a relatively short period of time, in particular after transmittal of the data in the form of checked package routing codes to a central computer, and stored intermediately in the HUB center. Subsequently, based on the intermediately generated computer data for each of the packages with the package routing code as a distinct identification feature, a largely automated alignment, stacking and/or sorting, controlled by the output signal of the computer, in a delivery sequence takes place in preparation for the optimal distribution by means of transport boxes provided for the system as interchangeable containers.

This generation and storage of package routing codes as package features in a central computer is matched to an intermediate storage and sorting of the packages in the HUB center such that at its exit a distribution-compatible sorted package stack or a distribution-compatible loaded box is generated. In this package box each package is positioned at a predetermined transport position and each package stack with the computed routing data can be received in a distribution vehicle that is being guided along a shortest possible transport path. Along the path into the distribution area, a combination of routes predetermined by the output signal of the computer and controlled by it is realized by simultaneous transport of several transport boxes on a vehicle, for example, a truck, a railway car or the like that carries out a main run.

In addition, the package routing codes contained in the central computer are transmitted by means of an appropriate communication technology to the final distribution vehicle. In this vehicle, by combining the package routing codes with, for example, a navigation system, for example, a GPS system, utilizing an electronic address list with road maps, the predetermined route is indicated and guided. In this way, even less experienced operating personnel can follow a dynamically optimized route planning with correspondingly stacked packages on a shortest possible path and with high verification safety. By feedback of the package routing code that is provided on an appropriate information carrier on the package and that is readable upon delivery, a continuous tracking action to the final addressee is possible.

If needed, the onboard computer can provide at any time information in regard to the position of the transport box or by means of a mobile command from the central computer a scanner that can be used within the box can identify the packages and can find a package that is being tracked.

The sensors and programs that are used in the HUB center or the central computer for dynamic routing optimization are provided for recording size data (length, width, height, weight) as further information in addition to the package code, which information has not been used prior for package labeling. The package routing codes generated as sorting and loading information are matched to transport boxes that provide distribution-optimized package stacks so that the packages can be removed from th transport boxes in the sequence of the optimized route. At the same time, with the programs of the central computer the control within the HUB center for intermediate storage and retrieval of packages is affected so that in any cycle in preparation for dynamic transport optimization a pre-computed distribution of the packages onto the transport boxes is realized. Also, it is provided that at any time by means of the reading devices provided at the control a correlation to the dynamically optimized route is enabled. In this way, tracking of the packages is ensured at any time while an optimal filling of the cargo space, an optimal routing computation, and qualitatively continuous distribution are provided.

For the process of identification of packages, data carriers can be used that are available on the market and can be secured on the package onto which the additional information acquired by the sensors system can be applied. In this process, the individual package is permanently tracked by identity control, and, by means of acquiring measurements (length, width, height, weight), an expanded data set for space and weight computation in accordance with the parameters of the transport boxes is achieved. The sensor data are combined in the central computer with continuously updatable programs so that an optimal distribution route is determined based on GPS information that can be coupled with the address data. In this connection, when computing a distribution route, the maximum receiving capacity of the transport boxes taking into consideration the geometry of the packages is calculated and the correlation of each package within the transport box as well as the assignment of a transport space are checked in such a way that within a first distribution phase, in particular, at a trans-shipment center, transport boxes received from a HUB center have a package arrangement in accordance with a last-in-first-out sequence of the packages and are received in this way for the second distribution phase by the final distribution vehicles.

In the method according to the invention, it is provided that the packages, in particular, within a time window that is provided for a day trip, for example, between 10 p.m. and 2 a.m., are provided by the data processing system with the package routing code, for example, located on a transponder; subsequently, the sorted packages in the afore described transport boxes are transported to a trans-shipment center that is referred to as mini distribution center and, starting here, a distribution takes place where daily new distribution areas, computed by the central computer for the transport boxes, are defined and these areas are supplied by means of the final distribution vehicles.

The program technology of the central computer enables a transmittal of the data regarding the contents of the respective transport boxes that can be derived from the package routing code to a mobile acquisition device in the area of the driver of the final distribution vehicle so that in the device a traceable stop list is available and at the same time distinct information for selecting a route is available for a navigation system (GPS, CRS) provided in the final distribution vehicle. By tracking it, at the same time an automatic and continuos tracking action that is largely independent of the operating personnel is achieved.

The method according to the present invention for distribution and delivery of packages enables with an advantageously minimal number of vehicles the combination of collecting and distribution routes wherein with the automatic manipulation of the individual packages in the intermediate storage facility of the HUB center savings in regard to further distribution steps is achieved. By means of a dynamic optimized route planning that is updated daily, the vehicles leaving the HUB center or the respective final distribution vehicles have been assigned in any case an optimal driving route in such a way that, based on reduced travel distances, further cost savings can be achieved for the trucking company.

BRIEF DESCRIPTION OF THE DRAWINGS

With regard to further details and advantageous of the invention, reference is being had to the following description and drawings in which the method and device according to the invention will be explained in principle based on one embodiment. The drawing shows in.

DESCRIPTION OF PREFERRED EMBODIMENTS

Figure 1:
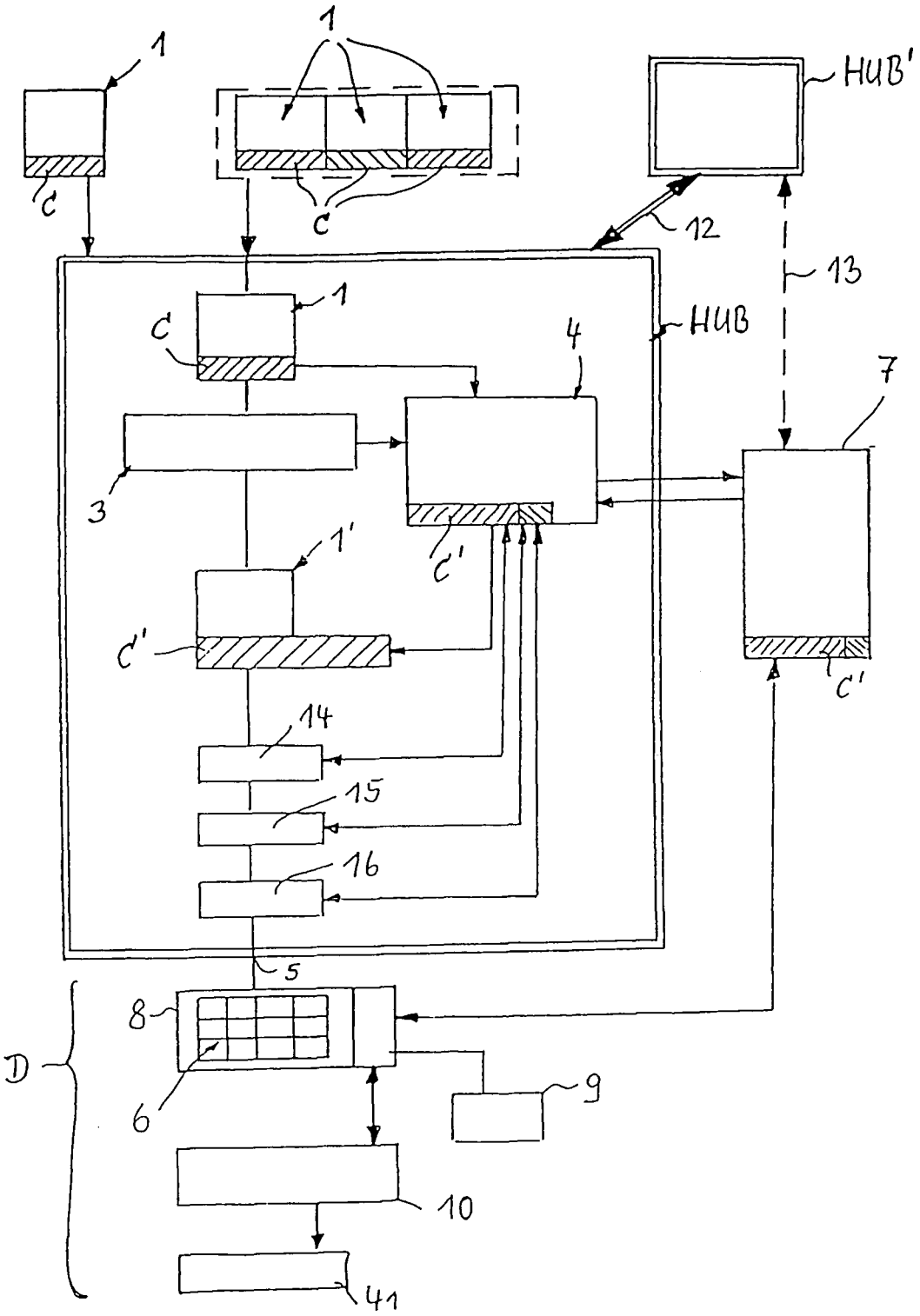
FIG. 1 a basic illustration the course of packages with a HUB center.

In FIG. 1 the devices for performing the method according to the invention are illustrated in a basic illustration from which the method for distribution of individual packages 1 (left upper corner, FIG. 1) or packages 1 collected at a collecting location 2 can be derived. The packages 1 that are to be transported particularly from private and/or commercial senders to an addressee 41 (FIG. 4) are acquired at the the collecting location 2 (FIG. 2) and the packages 1 are provided at the collecting location with a label provided with address, package number or the like as a package code C of electronically detectable data, wherein the code includes an unequivocal and electronically readable identification number. In known distribution methods, the packages 1 are picked up at this collecting center 2 by transport vehicles and subsequently distributed or directly delivered.

In the method according to the invention for distributing packages 1 or similar dispatched articles, it is provided that the collected packages 1 are transported to a HUB center as a trans-shipment and sorting center that is connected to one or several collecting locations 2; the HUB center is a main trans-shipment base. At this HUB center, the size data of the package 1, in particular the so-called girth measurements in the form of length, width, and height as well as the weight are determined. These packaging codes C' combined in the identification number contain in particular also geo coordinates for the address of the addressee that are also entered into the computer of the HUB center. Accordingly, additional measured data are present that are important for the method according to the invention; they are correlated with the respective package 1' in the form of a package routing code C'.

The measured data of all packages 1 can be acquired, for example, by means of a HUB computer 4 that generates the package routing code C' or can be supplied directly to a central computer 7. It is also conceivable that the original packaging code C is directly transmitted to the central computer 7 in which the package routing code C' is then generated.

In the HUB center the packages 1' are arranged by means of the data that are provided by the HUB computer 4 and/or the central computer 7 in a distribution-compatible sequence so that at the exit 5 this sequence can be removed in the form of a package stack 6. These data of the distribution-compatible sequence of the package stack 6 as well as the data of the package routing code C' have been processed in the meantime by means of the central computer 7 in the sense of a dynamically optimizable route planning so that the stacks 6 loaded in a transport box 30 (FIG. 2) or the codes C' are received by a vehicle 8 in a distribution-compatible sorted arrangement. In this way, the packages are delivered to a mini distribution center 18 and, subsequently, the packages 1' are delivered in an automatically controllable way by means of a GPS-controlled distribution 9 to the addressee 41 along an optimized distribution route 10.

Figure 5:
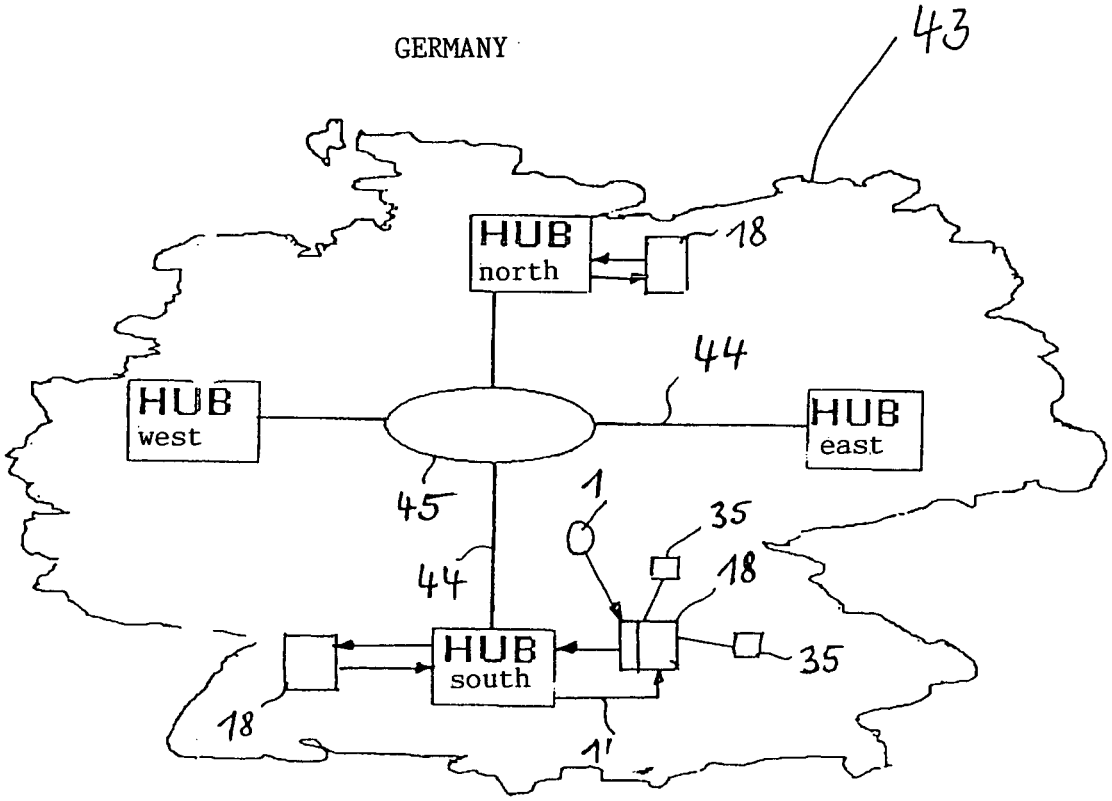
FIG. 5 an overview illustration of several HUB centers that are connected by a central vehicle fleet within a predetermined distribution territory.

When looking both at FIG. 1 and FIG. 5, it is apparent that within a distribution territory several HUB centers can be provided wherein the center identified at HUB' in FIG. 1 can be directly connected by a communication line 12 to the HUB center. By means of a connecting line 13 it is illustrated in FIG. 1 that several centers HUB and HUB' can be controlled by the central computer 7.

Within the respective HUB center, the packages 1' are transported by an appropriate computer control to an intermediate storage facility 14 that has predefined storage locations, and the packages 1' are stored therein within a time window that is predetermined by data processing in the computer; subsequently, the packages 1' are moved by means of a sorting device 15 into a distribution-compatible sequence and, by means of a stacking device 16, sorted into the distribution-compatible sorted package stack 6. In this way, the packages 1' are sent by the corresponding computer control to a defined loading location for a transport box wherein in this transport box the packages 1' are administered by means of a display function that is predetermined by data processing in the computer. Upon reaching the accumulation stretch 14 in front of the box, a large display 15 indicates to a loading device or a loading person in which way the package 1' is to be placed into the box 16. In this way, a last-in-first-out sequence (LIFO) of the packages to be delivered is realized in the transport box loaded at 6.

Figure 2:
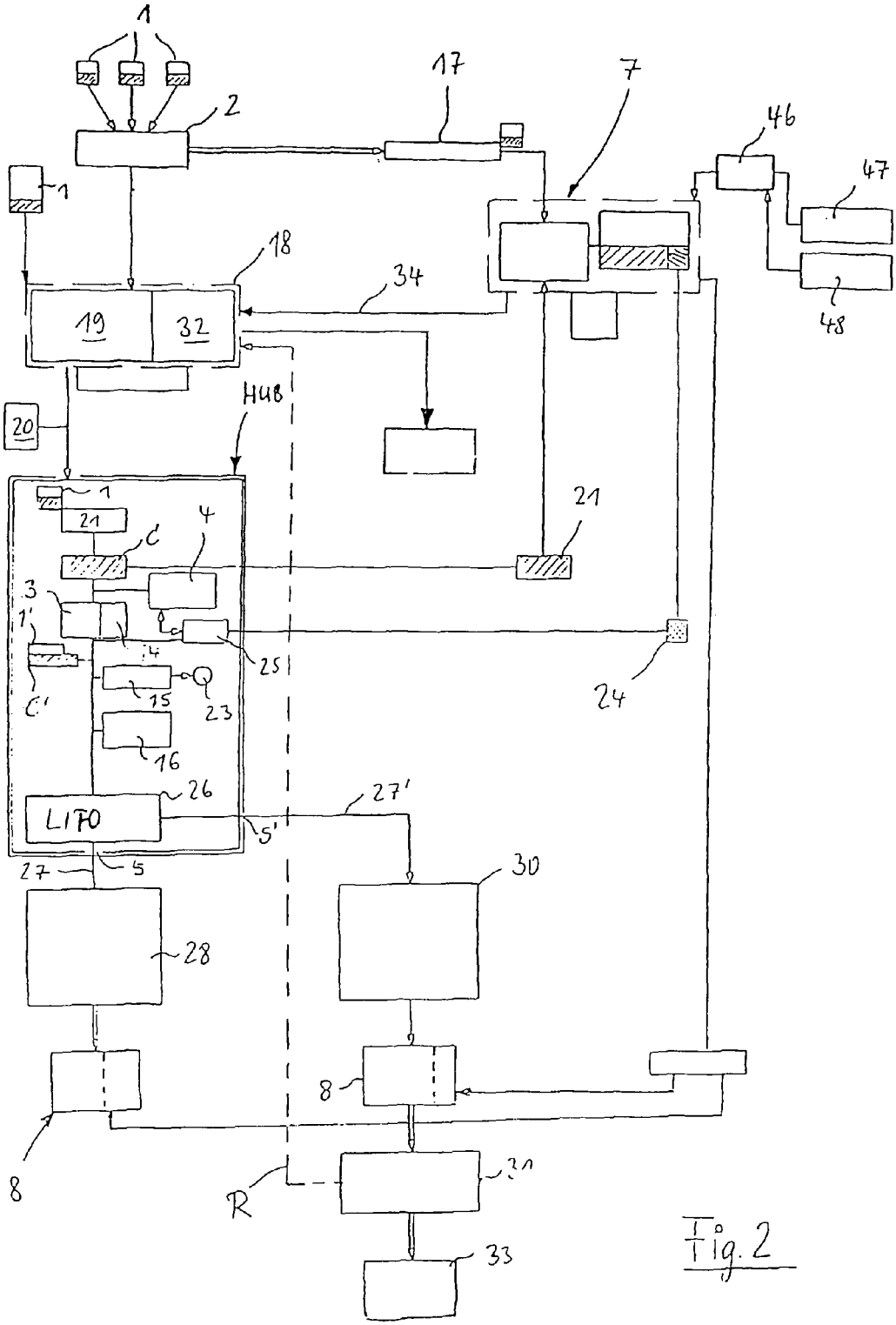
FIG. 2 a basic illustration similar to FIG. 1 with additional devices in connection with the HUB center.

In FIG. 2 an overview of the method control that has been expanded on in comparison to FIG. 1 is illustrated; at the decentralized collecting location 2 the packages 1 are provided with a machine-readable information carrier C (for example, a transponder, a barcode) and, starting at the collecting location 2, the packaging codes C are sent as a data set to the central computer 7. At the same time or with time delay the packages 1 received by transport means are transported away from the respective collecting locations 2 to a receiving area 19 of a common trans-shipment center 18 in the form of a mini distribution center from where the packages 1 in the form of a random transport quantity 20 are further transported by means of a vehicle 20' (FIG. 4) to the HUB center. In the area of arrival 21 completeness checks can be performed by controlling all package codes C. In this connection, the codes C are read into the HUB computer 4 or directly acquired by the central computer 7 by means of a comparator 21. In this way, in this acquisition phase a first control is achieved.

Subsequently, the packages 1 are supplied to the measuring device 3 (FIG. 4) and the package codes C with the size data are compared to the electronically processed package routing code C'. At the same time, the package 1' can be assigned a defined main sorting path in the area of a storage location 14' by means of a sorting control provided within the intermediate storage facility 14 from where the sorting device 15, for example, in the form of shelves, conveyor belts or similar modules 23, can be controlled. Subsequently, the packages 1' can be removed in a defined way from the intermediate storage facility 14 (FIG. 2) by means of the stacking device, generally identified by 16.

For this handling of the packages 1' in the HUB center it is provided that from the central computer 7 a data set 24 can be transmitted to an SPC control unit 25 (stored-program control) in the HUB center so that from this moment on the packages 1' are provided for further passage with a routing code C' with geo coordinates, address data, a route number, a transport box location, as well as route planning data (for example, time window).

Based on these complete control commands according to the respective code C', the packages 1' can be removed, presorted in accordance with distribution zones, from the intermediate storage facility 14 and by means of stacking device 16 can be arranged in an arrangement 26 (FIG. 2) in which the sorted packages 1' can be loaded in a transport-compatible last-in-first-out arrangement. Upon passing the exit 5 of the HUB center, the expanded data of the package routing code C' can be applied by means of adhesive labels, by electronic labeling of transponders or similar information carriers in the area 27 on the stacks 6 or the individual packages.

In a first variant of the further distribution according to FIG. 2, it is conceivable that the package stacks 6 in the form of a pallet or similar support part 28 and definable as the contents of the transport box are transferred as a whole to the vehicle 8 for further distribution. In the second variant of handling of the stack arrangement 26 illustrated at the exit 5' in the area 27', it is provided that the package stack 6 is generated in a transport box 30 wherein the package transfer into the predetermined position that can be controlled by the code C' is performed manually or by means of appropriate transfer devices. Subsequently, the transport box or several of the transport boxes 30 can be transferred to the vehicle 8 and the vehicle is guided in accordance with the route planning 31 to a distribution area 32 of the trans-shipment center 18 (arrow R). Conceivable in this phase is also the immediate distribution of the packages 1' by means of the vehicle 8 and a route planning 33.

Figure 3:
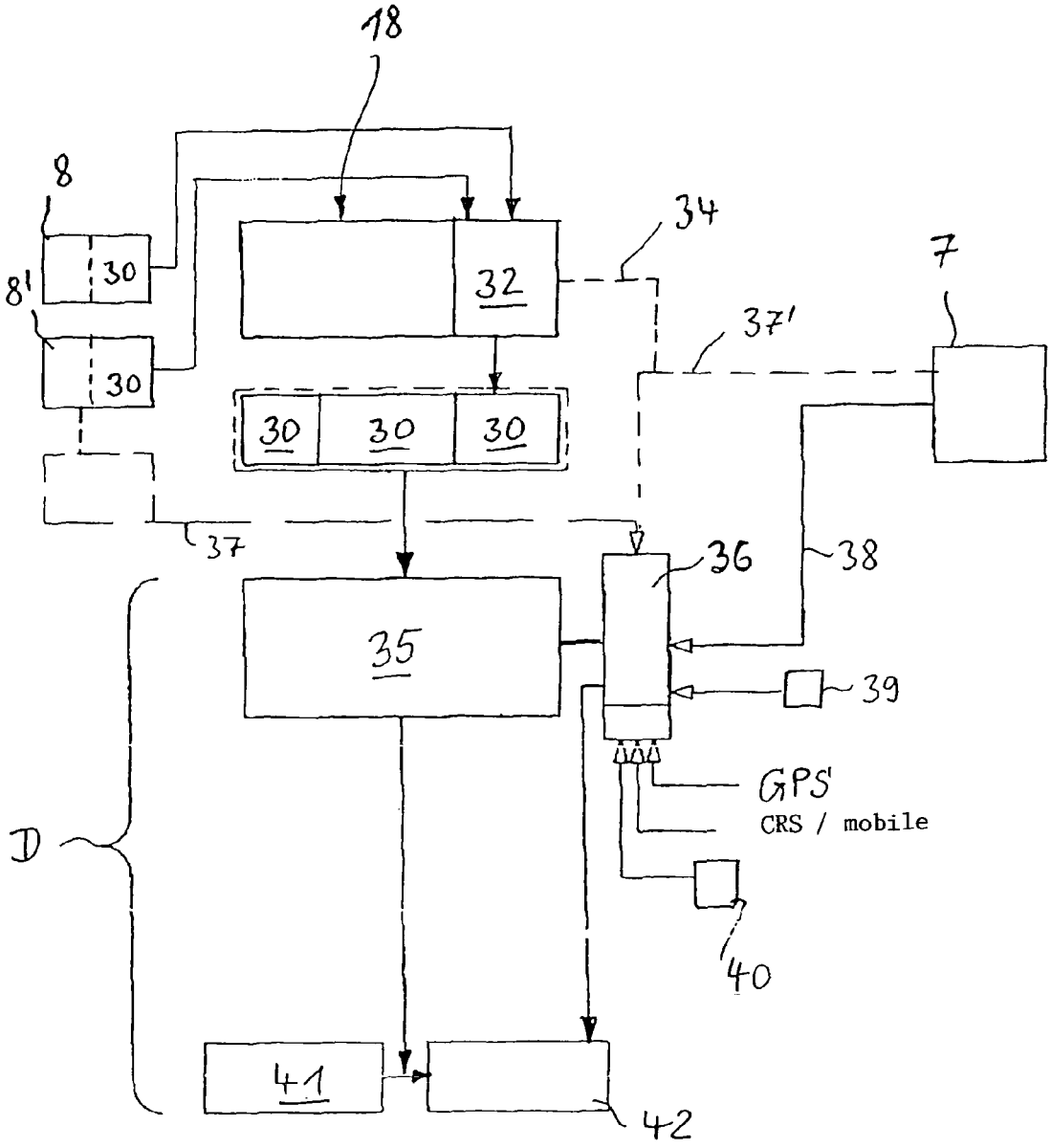
FIG. 3 a basic illustration of the course of packages in a distribution phase provided downstream of the HUB center.

For an optimal design of the system relative to the distribution sequence and the cargo space utilization, the final distribution of the packages 1' is provided by means of the trans-shipment center 18 or the distribution area 32 that receives the packages 1' that are sorted and arranged in accordance with distribution routes. In this area, the final distribution illustrated in FIG. 3 begins. The vehicles 8, 8' with the respective transport boxes 30 reach the distribution area 32 that is connected by a data line 34 (FIG. 2) to the central computer 7 so that several or individual ones of the transport boxes 30 are optimally assigned to a respective final distribution vehicle 35 and said vehicles carry out the dynamically optimized distribution route. Accordingly, in the area of the trans-shipment center 18 from a certain point in time on no vehicles with packages 1 or 1' are present anymore so that complex guarding in the area of the trans-shipment center 18 is not required.

The final distribution vehicle 35 is provided with a terminal device 36 identified as a whole by 36 onto which the data of the package routing code C' present for the respective transport box 30 or the package 1 can be transmitted by means of links 37 or 37'. The data that are present within the area of the central computer 7 can also be transmitted directly wireless, by diskette or similar connections 38 to the terminal device 36. The terminal device 36 is connectable to a navigation system, for example, GPS (global positioning system), CRS (cellular radio system) or similar devices in the form of auxiliary devices integrated into the distribution vehicle 35. In this connection, an internal vehicle control 39 is also provided, and the terminal device 36 can also provide a route print-out 40 with a stop list of the addressees 41. At the end of the dynamic optimized distribution route D the addressee 41 is reached who can acknowledge by means of an appropriate input device 42 receipt of the package 1' such that the data of the terminal device 36, checked by feedback to the central computer 7, acknowledge a continuous tracking.

Figure 4:
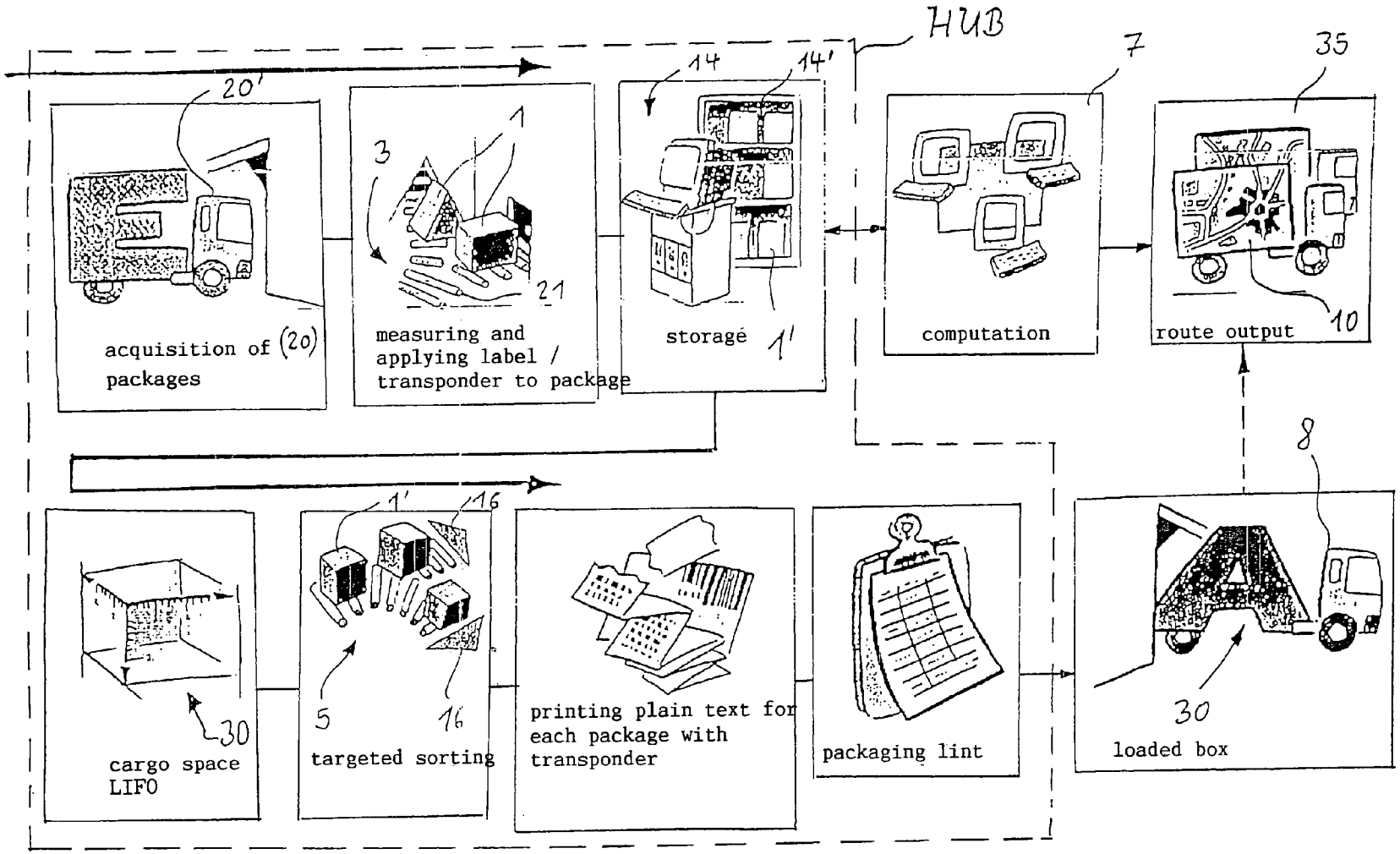
FIG. 4 a basic illustration of devices and their interaction provided within the area of the HUB center.

In FIG. 4, the interaction of the devices provided at a HUB center is illustrated in a basic illustration wherein at the arrival side by means of the transport vehicle 20 (FIG. 2) the random packages 1 are guided through an arrival conveying stretch 21 with the described measuring device 3 so that the routing codes C' of the packages are read and checked. They are subsequently supplied in a computer-controlled fashion to the storage facility 14 or can be sorted directly into the transport box 30. When doing so, an optimal loading is computed. Outside of the HUB center, the central computer 7 and its connection to the HUB center as well as the final distribution vehicles 35 are illustrated.

In the HUB center, a plurality of support devices in the form of transport boxes 30 are provided that determine especially with standardized dimensions the space for receiving the packages 1'. The packages 1' are sorted into these transport boxes 30 in a targeted way by means of stacking devices 16 for which purpose at the exit a conveying stretch 5 is provided that interacts with the packing and stacking devices 16, not illustrated in detail. The result of this process that determines the distribution-compatible sequence and stacking positions in the area of the transport box 30 is detected by the computer 4 or 7 and can be printed as plain text or can be represented on a large display or each package 1' is provided with the transponder or similar supplemented information carrier. In this way, the transport boxes 30 are loaded in accordance with the LIFO principle and by means of the vehicle 8 the transport to a trans-shipment center (mini distribution center) is realized (FIG. 4). The final distribution is realized through the trans-shipment center 18 in accordance with the method control illustrated in FIG. 3.

In FIG. 5, for a distribution territory 43 the expedient arrangement of four HUB centers (north, south, east, west) is illustrated which can communicate with one another by the connection or connections illustrated in principle at 12 or 13 in FIG. 1. FIG. 5 shows that in the area of the trans-shipment center 18 or the upstream collecting location 2 the package codes C as identification information are read by means of a reading device so that in this generally known reading device all data C of acquisitions of a day are contained. These reading devices can be connected in the acquisition area of the package 1, for example, on the transport box 30, at the trans-shipment center 18, at an electronic transfer location and, in this way, the package data C can be transmitted to the computers 4 or 7. The transmittal of the data C' from the reading device to the computers 5 or 7 is also possible by a cellular network.

These data C (address of destination, sender, code) and the measured data in the form of the routing code C' (dimensions, weight) are present on the day of acquisition at a predetermined time, for example, 10 p.m., at the central computer 7 (FIG. 1) so that in the computer the output data required for controlling the system are optimally generated.

By means of the central computer 7 the package routing codes C' are divided in accordance with the corresponding postal codes in the zones south, north, west and east wherein the assignment of the postal code areas to the HUB center is fixed and unequivocal. In these postal code areas, there is a main distribution center in the form of the HUB center for performing the distribution process as explained in FIG. 1. It is also conceivable in this connection that between the HUB centers or individually correlated therewith the respective trans-shipment centers 18 are provided and that the packages 1', in accordance with the second method step, are received therein with the transport boxes 30 and the latter are then transferred onto and distributed by means of the final distribution vehicles 35.

Between the HUB centers long distance transport 44, not illustrated in detail, can be provided (FIG. 5) so that in an area 45, illustrated as a common center, an exchange of transport boxes 30 is possible and from this area 45 the respective vehicles are returned again by nighttime transfer to the initial location (north, south, east, west).

The described system can be provided in the area of the central computer 7 with adaptive program components 46 (FIG. 2, upper right corner), wherein, for example, geo data and digital maps 47 and/or corrective programs 48 for distance matrices interact, with which, in deviation from a calculated route, corrections are possible and a missed pickup/missed delivery at the addressee 41 can be recorded and stored.

The afore described modules of the devices provided in the HUB centers are largely variable with regard to their configuration wherein the arrival side measuring device 3 can be provided additionally with reading devices for recording the sender or with marking devices. The measurements of the package 1 provided for the method control can be acquired, for example, by means of optical or mechanical sensors, image recognition methods or similar devices. The conveying technology provided in the HUB center in the area 14, 15, 16 can carry out, for example, sorting in accordance with package information C, HUB centers, routing areas, postal codes, geo coordinates, and/or basic data of the central computer. The gripping devices for the packages 1' provided in the area of conveying technology can be designed such that in accordance with the acquired measurements of the packages 1 an optimal gripping and transport into the transport boxes 30 is realized. For loading the transport boxes 30 appropriate lifting devices, gliding devices and/or hoisting devices can be provided; they can also be provided in appropriately modified configuration in the area of the trans-shipment center 18 for redistributing the transport boxes 30.

The information input or transfer illustrated by means of the terminal device 36 (FIG. 3) in the area of the final distribution vehicle 35 can be supplemented in that traffic management devices are used for guiding the vehicle and in that in place of the receipt acknowledgment 42 a storage of information to post office boxes for packages is possible with packages 1'. For the transfer of the data compiled in regard to the contents of a transport box 30, the use of a computer print-out, of the already described transponder, or of a computer-written data carrier is conceivable. The routing data are transferred to the navigation system for guiding the vehicle 8 or 35, and, for controlling this guiding action, the corresponding routing list can be directly read and realized by the driver. Conceivable in this connection is also an additional driving aid into which the distribution route is input for assisting the driver. The receipt acknowledgment provided by the addressee 42 can be realized on paper or on a data carrier or, in the case of storage of packages 1' in a post office box for packages, the return of the post office box authorization can serve as a receipt.

The invention claimed is:

1. A method for distributing packages or similar dispatched articles, the method comprising the steps of:

acquiring packages that are to be transported from private senders and/or commercial senders to an addressee at collecting locations;

providing the packages at the collecting locations with a package code containing at least an address and a package number as electronically detectable data;

supplying the collected packages to a HUB center that is associated with the collecting locations combining in the HUB center the package codes with data sets comprising measurement data (length, width, height, weight), geo coordinates (addressees) and identification data of the packages, respectively, to controllable package routing codes, respectively;

supplying the package routing codes of all the packages to a central computer arranging the packages according to output signals that are generated by a program of the central computer and that effect a dynamically optimizable route planning in a sorted package sequence sorted in accordance with distribution zones;

introducing the sorted package sequence and the package routing codes into transport boxes in a distribution-compatible sorted arrangements;

transferring the transport boxes onto a vehicle;

delivering automatically controlled the packages by a navigation-controlled distribution to the addressee, respectively.

2. The method according to claim 1, wherein the data sets comprising the measurement data, geo coordinates, and identification data are acquired already at the collecting locations, at a client, or directly at the sender, are transmitted to the central computer, and, subsequently, the data sets are checked when the packages arrive in the HUB center.

3. The method according to claim 1, wherein several of the HUB center are controlled by the central computer.

4. The method according to claim 1, further comprising the step of supplying the packages in the HUB center by computer control to an intermediate storage facility having defined storage locations, storing the packages in the intermediate storage facility within a predetermined time window, and, subsequently, removing the packages in a distribution-compatible sequence.

5. The method according to claim 1, wherein in each of the collecting locations that are decentralized, the packages are provided with a machine-readable information carrier, the respective package code is electronically acquired as identification information and supplied to the central computer, the packages of the collecting locations are transported in a transport box to a common trans-shipment center, from the trans-shipment center, the packages as a random transport quantity are transported in the transport box to the HUB center, in the HUB center, the package codes are read into a HUB computer for checking completeness of the packages, the package routing codes are generated from the package codes and the data sets as an electronically checked package routing code, respectively, the package routing codes are supplied to the central computer and processed in accordance with the dynamically optimizable route planning, computed data of the dynamically optimizable route planning are transmitted to the HUB computer and to the trans-shipment centers contained within the dynamically optimizable route planning, the packages are arranged in package stacks in a transport-compatible way in a last-in-first-out arrangement, one or several of the generated package stacks are removed from the HUB center, the package stacks are introduced into transport boxes and are transported by a transport vehicle to the trans-shipment center, in the trans-shipment center the package stacks are transferred to a distribution vehicle, the distribution vehicle receives the package routing codes of one or several package stacks contained in the transport boxes from the central computer, subsequently, by means of a distribution route that is controlled by a navigation system, the packages are delivered to the addressee with the optimized route planning, and the package routing codes are compared with test data.

6. The method according to claim 1, wherein the dynamically optimized route planning is performed by the central computer in a time window that enables delivery of the packages on a day following the day of acquiring the packages.

7. The method according to claim 1, the collecting locations are the addresses of the senders and the packages are picked up by a pickup service and are provided by the pickup service with an information carrier receiving the packaging codes.

8. The method according to claim 1, wherein the packages are supplied from the collecting locations directly to the HUB center.

9. The method according to claim 1, wherein the central computers is provided with programs into which a complete address list, postal codes to be correlated therewith, and actual geo coordinates are entered.

10. The method according to claim 1, wherein with the programs of the central computer respective limit ranges of the package dimensions, a maximum number of packages that can be delivered in a package stack or in the transport box, and a time window for package delivery can be predetermined.

11. A device for distributing packages or similar dispatched articles for performing the method according to claim 1, the device comprising:

a HUB center and in the area of the HUB center measuring device comprising sensor units for detecting identification data, package sizes (length, width, height, weight), addresses and geo coordinates, respectively;

a central computer, wherein measured data measured by the measuring device are supplied to the central computer correlating the measured data to the packages as package routing codes such that by means of the measured data processed by the central computer in the HUB center a control action is effected with which the packages are transferable in an ordered sequence into at least one vehicle and the packages are distributable by a route planning that is dynamically optimized by the package routing codes.

12. The device according to claim 11, wherein, for detecting and identifying the packages by package codes, a transponder as an information carrier is secured on the packages, wherein data of the transponder are acquired in the area of the HUB center that is configured as a sorting location and has a HUB computer with a stored-program control unit connected to the central computer, which HUB computer for handling the packages interacts respectively with sensor devices, controlled storage devices, packing devices, and distribution systems on the basis of the geo coordinates.

13. The device according to claim 12, wherein the sensor units are arranged in the HUB center in the area of an arrival conveying stretch and individually measure the packages, wherein comparing and measuring results of the sensor units are transmitted in the form of the package routing codes to the transponder forming the information carrier and to the HUB computer.

14. The device according to claim 11, wherein the HUB center in the area of an exit conveying stretch is provided with a packing device and a support device receiving package stacks contained in a transport box.

15. The device according to claim 11, wherein as a support device for sorted package stacks a transport box having standardized dimensions is provided.

16. The device according to claim 11, wherein selected packages in the area upstream of a packing device pass through a transport system that distributes the packages in a targeted way for transfer into transport boxes.

17. The device according to claim 11, wherein the package routing codes generated in the central computer for a transport box, respectively, are transmitted wireless or by a data storage medium onto a terminal device provided in a distribution vehicle.

18. The device according to claim 17, wherein a navigation system or auxiliary devices with an application for geo coordinates that is integrated into the distribution vehicle are connectable to the terminal device.

19. The device according to claim 17, wherein the terminal device has an input part that acknowledges the delivery of the package.

20. The method according to claim 1, wherein at least one of the steps of: combining the package codes, supplying the package routing codes, or introducing the sorted package sequence and the package routing codes occurs on a predetermined periodic basis.

21. The method according to claim 20, wherein the period of the predetermined periodic basis is daily.

22. The device according to claim 11, wherein the control action is performed on a predetermined periodic basis.

23. The device according to claim 22, wherein the period of the predetermined periodic basis is daily.

* * * * *